US008250779B2

(12) United States Patent
Bell et al.

(10) Patent No.: US 8,250,779 B2
(45) Date of Patent: Aug. 28, 2012

(54) OVERSHOE

(75) Inventors: Jordan David Bell, Lafayette Hill, PA (US); Jonathan Marc Bell, Maple Glen, PA (US)

(73) Assignee: Joneric Products, Inc., Horsham, PA (US)

( * ) Notice: Subject to any disclaimer, the term of this patent is extended or adjusted under 35 U.S.C. 154(b) by 609 days.

(21) Appl. No.: 12/422,535

(22) Filed: Apr. 13, 2009

(65) Prior Publication Data

US 2010/0257750 A1 Oct. 14, 2010

(51) Int. Cl.
*A43B 3/16* (2006.01)
*A43C 15/00* (2006.01)

(52) U.S. Cl. ..... 36/7.6; 36/7.1 R

(58) Field of Classification Search ..... 36/7.1 R, 36/7.2–7.8, 114, 50.1
See application file for complete search history.

(56) References Cited

U.S. PATENT DOCUMENTS 2,628,437 A * 2/1953 Forsythe ..... 36/7.7
3,019,533 A * 2/1962 Smith ..... 36/7.6
3,021,617 A * 2/1962 Koch ..... 36/7.6
3,040,451 A * 6/1962 Hilkemeyer ..... 36/7.5
4,635,383 A * 1/1987 Free ..... 36/7.6
5,359,789 A 11/1994 Bell
5,463,823 A * 11/1995 Bell et al. ..... 36/11.5
5,533,277 A 7/1996 Bell et al.
5,794,360 A 8/1998 Bell et al.
5,813,143 A 9/1998 Bell et al.
5,836,090 A 11/1998 Smith
5,921,005 A 7/1999 Bell et al.
5,966,840 A 10/1999 Bell et al.
6,154,982 A 12/2000 Bell et al.
6,968,634 B2 * 11/2005 Dombowsky ..... 36/11.5
7,222,440 B2 5/2007 Dombowsky
7,287,342 B2 * 10/2007 Keen ..... 36/50.1
7,703,218 B2 * 4/2010 Burgess ..... 36/7.6

* cited by examiner

*Primary Examiner* — Jila M Mohandesi
(74) *Attorney, Agent, or Firm* — HolzerIPLaw, PC

(57) ABSTRACT

A sandal type overshoe for releasable mounting on primary footwear, e.g., a boot or shoe, is disclosed. The overshoe comprises a sole with a forefoot region, a midfoot region, and a hindfoot portion. Toe, side and heel anchor pieces are disposed along the perimeter of the sole and accept two removable lace pieces, one of which connects the front anchor piece and the side anchor pieces, and one of which connects the heel anchor pieces to the side anchor pieces. The sole portion has a ground engaging surface that can provide enhanced traction or other functionality.

24 Claims, 6 Drawing Sheets

OVERSHOE

BACKGROUND

Primary footwear, such as shoes and boots, often provide inadequate traction under certain conditions. For example, even work boots, which often provide rugged tread on the bottom of their soles, may lack adequate traction on an icy surface, such as a frozen construction site or highway. Nevertheless, the other aspects of the primary work boot are suitable for their intended purposes, such to provide stability and protection to the foot. Various implementations for improving traction of primary footwear do not provide sufficient ease of use or stability.

SUMMARY

One or more of the above referenced problems is addressed by a sandal-type overshoe for releasable mounting on an article of primary footwear. In one implementation, the overshoe provides enhanced traction sole surfaces or other alternative sole surfaces, although other implementations may merely provide protection (e.g., to the sole of the primary footwear or the sole of the wearer's foot). The sandal-type nature and physical structure of the overshoe can allow for enhanced stability, easy manufacturing, replaceable parts, improved comfort, and easy entry into or exit from the overshoe. The laces (e.g., made from webbing, straps or cords, whether elastic or inelastic) may be easily removed and replaced without destroying or damaging the laces or disassembling the overshoe.

In one implementation, the overshoe includes a sole that underlies the sole of the primary footwear. The sole is sized to accommodate the sole of the primary footwear and is shaped with a perimeter that is roughly the shape of a shoe or boot sole. The sole may have one or more sole portion layers. When worn, the sole underlies the forefoot region, the midfoot region, and the hindfoot region of the user's primary footwear. The sole of the overshoe has toe, side, and heel anchor pieces attached thereto, although other implementations may also be employed. One or more of these anchor pieces may be integrally formed with at least one of the sole layers. A long axis is defined lengthwise between heel and toe and substantially along the center of the sole.

In one implementation, the toe anchor piece is split and has attachments to the sole on either side of the toe of the sole. The toe anchor piece is shaped to cover the front of the foot, and contains an aperture for receiving a front lace. In other implementations, a non-split structure may be employed for the toe anchor piece.

In another implementation, at least two heel anchor pieces are attached to the sole on either side of the heel of the sole. Each heel anchor piece comprises an aperture for receiving a rear lace. In alternative implementations, the at least two heel anchor pieces may be integrated or connected to form a single anchor brace having individual heel anchor pieces on either side of the axis of the sole.

In another implementation, at least two side anchor pieces are located near the midfoot on either side of the sole. The side anchor pieces contain at least one aperture each that receives a front lace to connect the side anchor piece of the overshoe to the toe anchor piece of the overshoe. The at least one aperture may also receive a rear lace, thus connecting the heel anchor pieces of the overshoe to the side anchor pieces of the overshoe. In one implementation, the side anchor pieces also provide lateral stability to the primary footwear inside the overshoe, by preventing the primary footwear from slipping off of the sole or by securing the primary footwear firmly against the sole.

In yet another implementation, the sole portion has some type of ground-engaging surface for providing enhanced traction, such as small studs, a grit coating, or a rubber compound formulated for enhanced traction. Other types of surfaces may also be used with the overshoe.

The lace system includes at least two replaceable lace pieces, one of which connects the heel anchor pieces to the side anchor pieces (i.e., the rear lace), and the second of which connects the split toe anchor piece to the at least two side anchor pieces (i.e., the front lace). Each lace is detachably anchored to one or more of the anchor pieces, such as by inserting through anchor piece apertures, folding over on itself, and detachably fastening to itself by a fastener or other attachment device (e.g., a hook and loop fastener, a snap, etc.) Accordingly, the lace system is easy to attach to the primary footwear, holding the overshoe securely to the wearer's primary footwear. When the front lace is tightened, the toe anchor piece is pulled backward and downward over the toe, and the side anchor pieces are pulled inward, thus assisting in securing the overshoe to the forefoot and instep of the primary footwear. When the rear lace is tightened, the heel anchor pieces are pulled forward and snugly on the heel of the primary footwear, pulling the primary footwear forward toward the toe anchor piece to connect more snugly onto the forefoot.

Other implementations are also described and recited herein.

DESCRIPTION OF THE DRAWINGS

Several implementations may become understood by reference to the following detailed description and the accompanying drawings.

DETAILED DESCRIPTION

Figure 1:
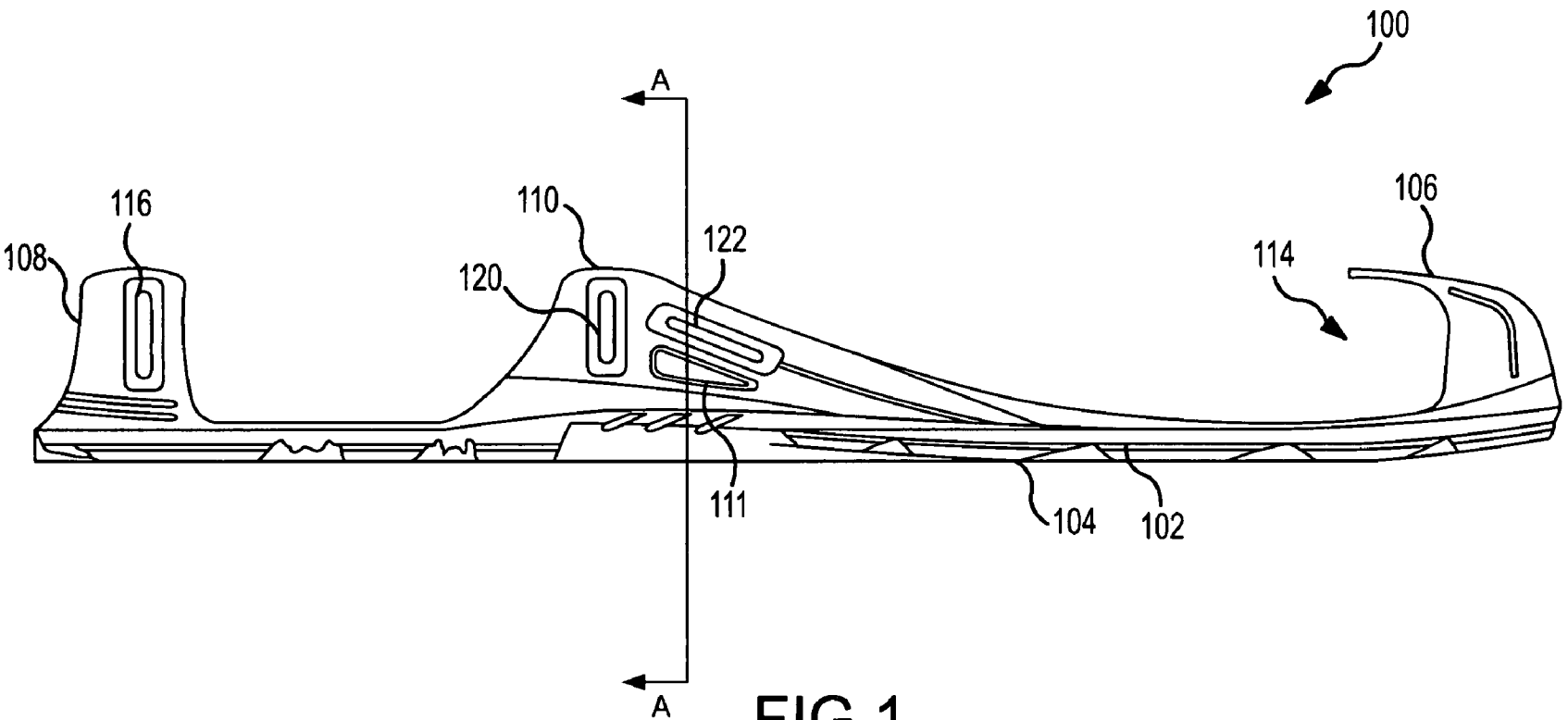
FIG. 1 depicts a lateral view of an example implementation of the overshoe.

FIGS. 1-6 illustrate various views of an example implementation of an overshoe. FIG. 1 illustrates a lateral view of an example implementation of an overshoe 100. As illustrated, the sole 102 of the overshoe 100 has a second sole portion 104 attached thereto as a second layer. However, it should be understood that certain variations can be made in the illustrated configuration to form alternative implementations, both in the overshoe itself and in the associated lacing system. The second sole portion 104 may be made separately and attached to the bottom portion of the sole 102. The second sole 104 may also be made of material that is more or less rigid than the sole portion. In other implementations, the overshoe 100 is not attached to any other sole portions, is attached to a sole portion having a different surface altogether (e.g., a waterproof surface, a slick ski-like surface, etc.), and/or has more than two sole portions attached to or constituting the sole 102.

When the overshoe 100 is oriented to be substantially level to the ground (with the second sole portion 104 facing down), a toe anchor piece 106 extends upwardly from the sole 102 and then toward the heel (i.e., rear) of the sole 102, so as to form a cavity 114 into which the toe portion of the wearer's primary footwear can be inserted. In addition, the toe anchor piece 106 includes an aperture (not shown in FIG. 1—see e.g., FIG. 2) through which a front lace (not shown in FIG. 1—see e.g., FIGS. 5 and 6) is inserted. As such, the front lace and the cavity of the toe anchor piece 106 contribute to preventing the wearer's primary footwear from sliding forward off of the sole 102 and from lifting off of the sole 102.

In the same orientation, two or more heel anchor pieces 108 extend upwardly from the sole 102. In one implementation, the two or more heel anchor pieces 108 extend substantially perpendicular from the sole 102, although in alternative implementations, the heel anchor pieces 108 are biased (e.g., molded at an angle) and/or curved inwardly toward the interior of the sole 102 (e.g., molded to provide a cavity for the heel of the wearer's primary footwear) or biased and/or curved outwardly away from the interior of the sole 102 (e.g., to make it easier for the wearer to insert his or her primary footwear). At least two of the heel anchor pieces are spaced apart, one on each side of the long axis 101 (see FIG. 2) between heel and toe of the sole 102, which can contribute to lateral stability of the heel in the overshoe 100.

In one angled implementation, each heel anchor piece 108 is molded to extend from the sole 102 away from the interior of the sole 102 at a non-perpendicular angle (e.g., between 0° to 50° from a perpendicular axis to the sole 102, and in particular within a 15° to 45° angle) to "open up" the heel portion of the overshoe 100. This "opening up" of the heel portion of the overshoe 100 facilitates insertion and withdrawal the heel of the primary footwear when the rear lace is loose. In one such outwardly angled implementation, proximal ends of the heel anchor pieces 108 (as viewed from the sole 102) are integrally molded to the sole 102 and the distal ends of the heel anchor pieces 108 flex independently of each other. Such independent movement allows the heel anchor pieces 108 to tilt outwardly at their distal ends at a non-perpendicular angle, thereby forming a larger heel opening than that defined by the perimeter of the overshoe 100 (when the rear lace is loose or absent). Yet these distal ends can be pulled together to angle inward to form a smaller heel opening than that defined by the perimeter of the overshoe 100. In this manner, the heel anchor pieces 108 and rear lace fit securely on the heel of the primary footwear of the wearer.

Figure 2:
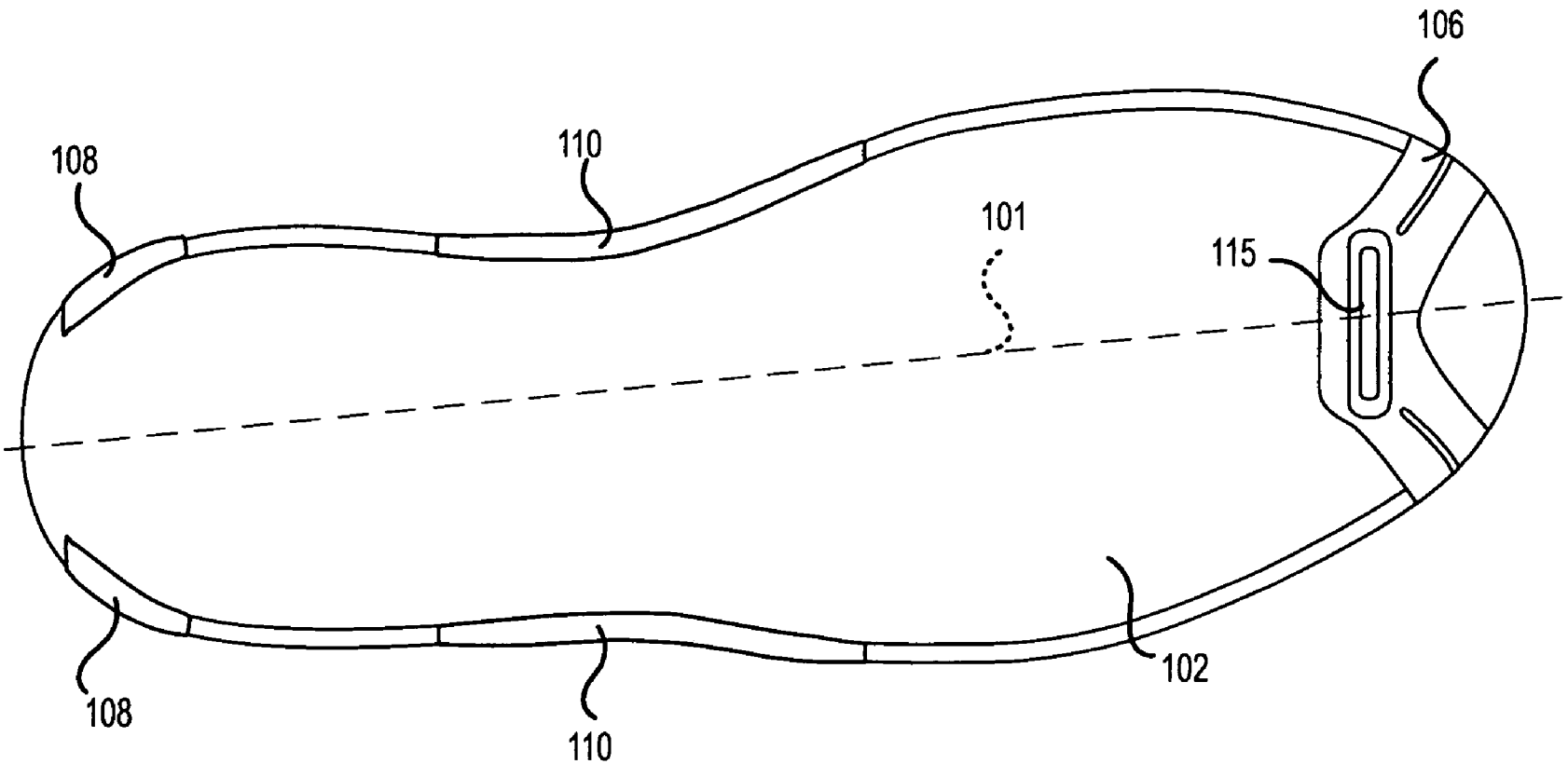
FIG. 2 depicts a top view of an example implementation of the overshoe.
Figure 3:
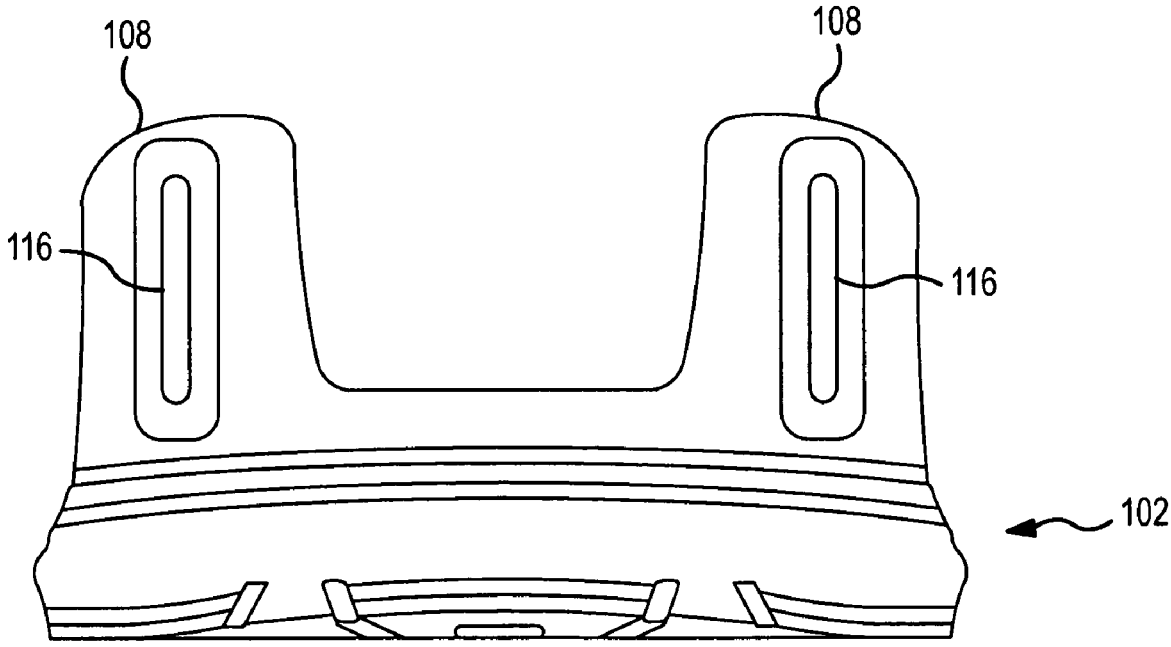
FIG. 3 depicts a back view of an example implementation of the overshoe.

The heel anchor pieces 108 include apertures 116 through which a rear lace (not shown in FIG. 1—see e.g., FIGS. 5 and 6) is inserted. By tightening the rear lace against the heel of the wearer's primary footwear, the rear lace pulls the two or more heel anchor pieces 108 toward the interior of the sole 102 to provide a secure fit and contributes to preventing the wearer's primary footwear from sliding rearward off of the sole 102 and from lifting off of the sole 102. In FIGS. 2 and 3, example locations of two heel anchor pieces 108 are shown on each side of the long heel-to-toe axis of the sole 102. In the rear lace implementation shown in FIG. 6, the rear lace enters the apertures 116 of the heel anchor pieces 108 from the interior side of each heel anchor piece 108, thus pulling the heel anchor pieces 108 toward the interior of the overshoe 100 and particularly toward the heel of the wearer's primary footwear.

It should also be understood that the two or more heel anchor pieces 108 may be connected to form a single heel brace (not shown). However, the individual heel anchor pieces 108 rising from the sole 102, whether connected together or completely separate, each include an aperture through which a rear lace may be inserted.

Figure 5:
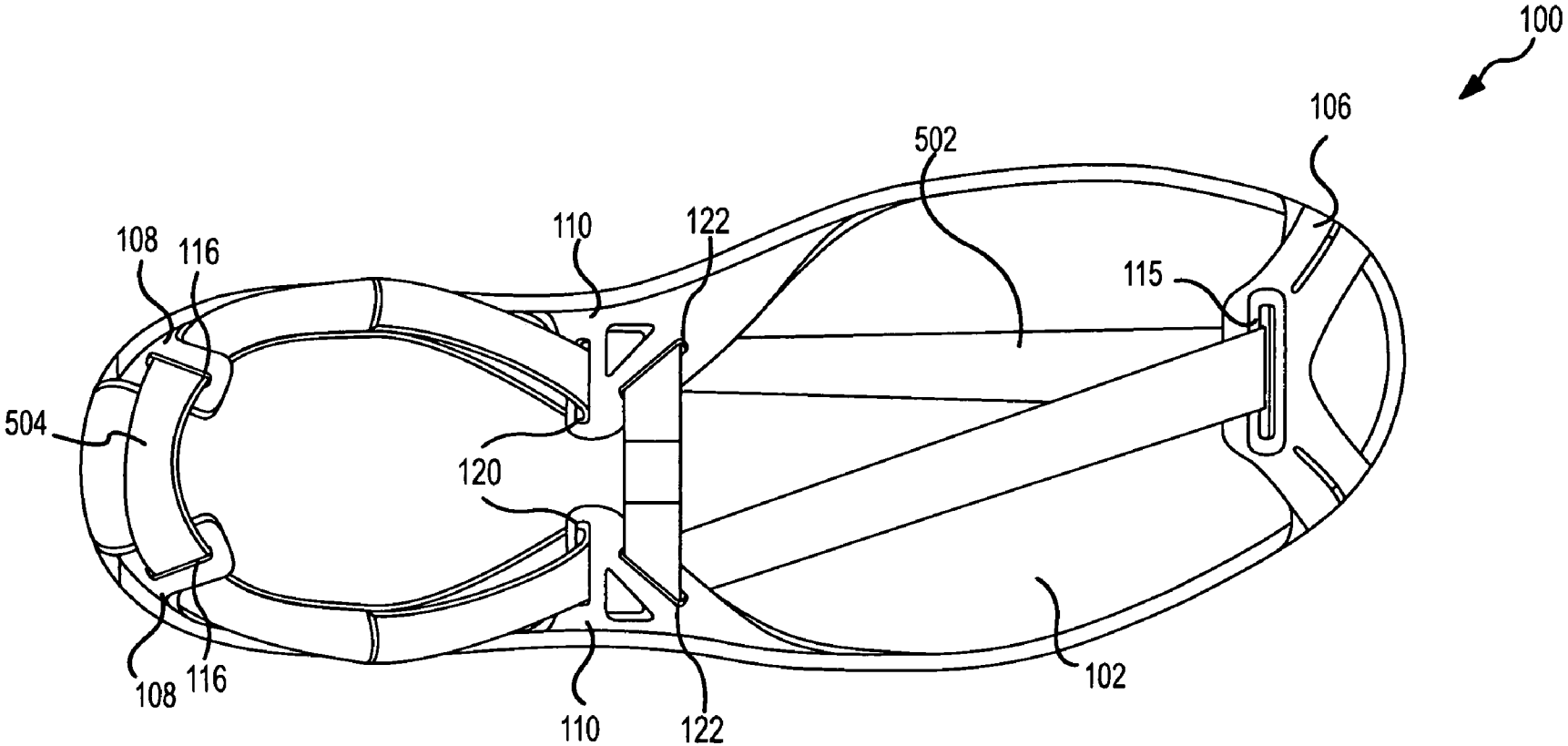
FIG. 5 depicts a top view of an example implementation of the overshoe with an example implementation of a lace system.

In the same orientation, two or more side anchor pieces 110 extend upwardly from the sole 102. FIGS. 1, 2, and 5 illustrate that the side anchor pieces 110 are located near the midfoot on either side of the sole perimeter such that they conveniently connect via laces to both the front anchor pieces and the heel anchor pieces. In one implementation, the two or more side anchor pieces 108 extend upwardly from the sole 102, although in alternative implementations, the side anchor pieces 110 are biased or curved inwardly toward the interior of the sole 102 (e.g., to provide a cavities for each side of the midfoot region of the wearer's primary footwear) or biased or curved outwardly away from the interior of the sole 102 (e.g., to make it easier for the wearer to insert his or her primary footwear).

The flexibility of the various anchor pieces contributes to the comfort and functionality of the overshoe 100. For example, the flexibility allows the overshoe 100 to adjust to a large variety and range of movements by the wearer and sizes of primary footwear. In one application, a wearer can use the overshoe 100 on a steeply pitched surface, such as a pitched roof or a hillside. The flexibility allows the overshoe 100 to adjust to the extreme angle while maintaining a secure grip on the wearer's primary footwear. Furthermore, the overshoe 100 can maintain substantial contact between the ground engagement surface of the sole 102 and the "ground" (e.g. the roof or other support surface).

Nevertheless, the various anchor pieces are also stiff enough to support the laces inserted through their apertures, maintaining separation between the sole 102 and the laces. For example, the heel anchor laces 108 remain substantially upright when the rear lace is laced through their apertures 116, so that the rear lace remains supported above the sole 102. This stiffness helps secure the primary footwear in the overshoe 100, by supporting the rear lace high enough on the heel of the primary footwear to prevent the primary footwear from slipping out and to secure the heel of the primary footwear firmly against the sole 102.

The side anchor pieces 110 include apertures 120 through which a rear lace (not shown in FIG. 1—see e.g., FIG. 6) is inserted, and the ends of the rear lace are anchored to the side anchor pieces 110 (e.g., by folding the ends back onto each other to fasten together using an attachment device, such as a hook and loop fastener, one or more snaps, a tongue and buckle, etc.). Furthermore, as previously described, the rear lace is also threaded through the apertures 116 of the heel anchors 108. By anchoring the rear lace to the side anchor pieces 110 and tightening the rear lace against the heel of the wearer's primary footwear, the rear lace pulls the two or more heel anchor pieces 108 toward the interior of the sole 102 to provide a secure fit and contribute to preventing the wearer's primary footwear from sliding rearward off of the sole 102 and from lifting off of the sole 102.

Figure 6:
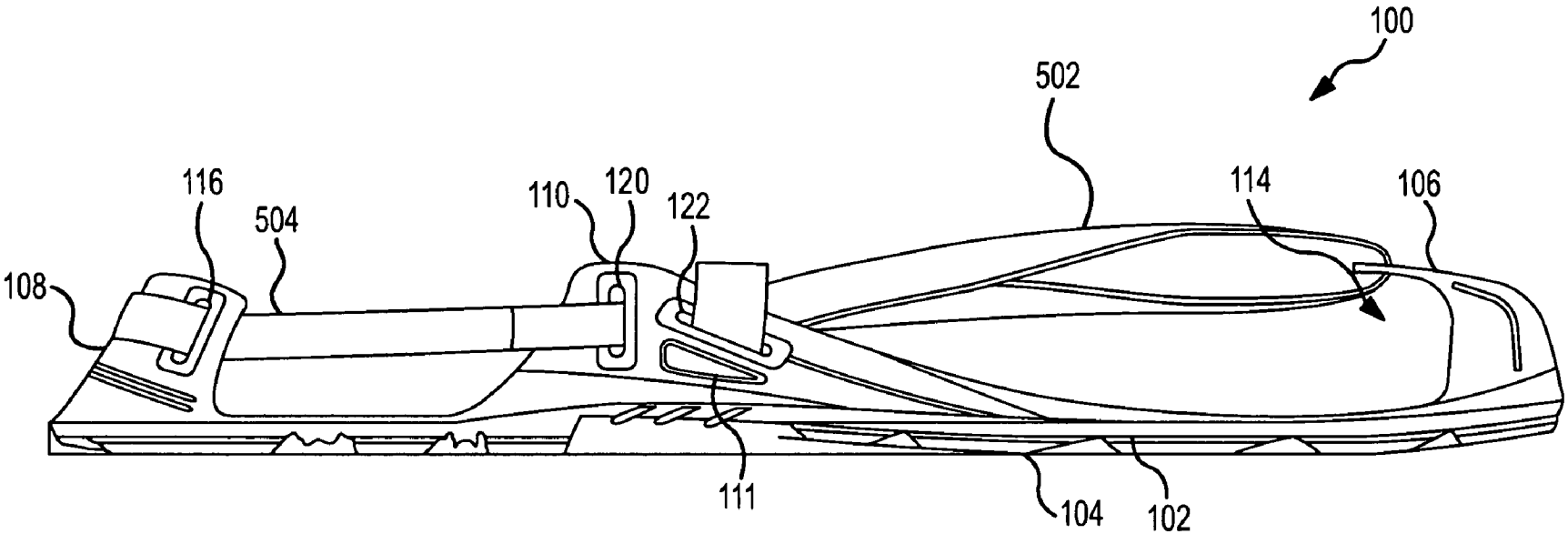
FIG. 6 depicts a side view of an example implementation of the overshoe with an example implementation of a lace system.

The side anchor pieces 110 also include apertures 122 through which a front lace (not shown in FIG. 1—see e.g., FIG. 6) is inserted, and the ends of the front lace are fastened together over the top of the midfoot of the wearer's primary footwear (e.g., using an attachment device, such as a hook and loop fastener, one or more snaps, a tongue and buckle, etc.) as shown in FIG. 6. As previously described, the front lace is also threaded through the aperture 115 of the toe anchor piece 114. By tightening the front lace against the top of the midfoot of the wearer's primary footwear, the front lace pulls the side anchor pieces 110 inward and the toe anchor piece 114 rearward (and possibly downward) to provide a secure fit and contribute to preventing the wearer's primary footwear from sliding sideways or forward off of the sole 102 and from lifting off of the sole 102. Furthermore, the forward extension of the side anchor pieces 110 also provides an obstacle to lateral slippage of the primary footwear in the region of the ball of the foot.

It should be understood that, in one implementation, the apertures 120 and 122 may be implemented using a single aperture in the side anchor pieces 110. Furthermore, FIG. 1 illustrates a third aperture 111. In FIGS. 2 and 3, example locations of two side anchor pieces 110 are shown on each side of the long heel-to-toe axis 101 of the sole 102.

In one implementation, the sole 102 is made of a rigid or semi-rigid material, and the toe anchor piece 106, heel anchor piece 108, and a side anchor piece 110 are made of a material that is generally more flexible. The overshoe 100 may be formed as an integral unit of a resilient material, with portions of the upper being thinner to bend more readily than portions of the sole 102. Examples of resilient material may include without limitation rubber, polyvinyl choloride (PVC), thermal plasticized rubber (TPR), etc. The thicker portions in the sole 102 can provide durability and cushioning for the overshoe. In the example implementation shown in FIG. 1, the overshoe 100 comprises a generally planar sole portion and several anchor pieces molded as an integral or one-piece member, and the second sole portion 104 attached with an adhesive to the bottom surface of the sole 102, although other configurations are contemplated (e.g., no second sole portion, multiple additional sole portions, thermally-bonded attachment between sole 102 and a second sole portion 104, etc.).

As described, the ground engaging surfaces of the overshoe 100 (e.g., the sole 102 or the second sole portion 104) may be constructed of any desired type to provide whatever type of traction is desired. For example, if it is desired that the overshoe 100 be utilized for general slippery conditions, the surfaces may include plural grooves and plural ridges, or any other type of tread commonly found in outdoor boots and shoes. These types of tread can provide good traction on all but the iciest conditions. For the iciest conditions, more rigid projections (e.g., spikes, screws, cleats, studs, etc.) are mounted to the sole 102 or second sole portion 104 to form at least a portion of the ground engaging surface. For example, such a ground engaging surface may have small tungsten studs, a grit coating, a specially formulated rubber compound, or another traction improving surface.

The studs or other traction enhancing materials may be located at various positions across the ground engaging portions of the sole 102 or second sole portion 104. In one implementation of the ground engaging portion, at least some studs are located close to the rear edge of the heel-sole section. In this manner, it is likely that at least one stud will engage the ground in normal walking motion, and therefore an anti-slip effect is obtained.

As previously described, in one implementation, the overshoe is molded as an integral unit from a single material, with portions of different thicknesses to provide the desired amount of flexibility in the anchor pieces. The overshoe 100 can be also formed of different materials, having different resiliency, hardness, etc., for the various parts of the overshoe 100, as desired. These various parts can be assembled to form a complete overshoe 100. In addition, laces may be removably inserted through the apertures of the various anchor pieces, and they can be used to anchor the overshoe 100 to the wearer's primary footwear.

The sandals may be made in different sizes to accommodate a range of sizes of primary footwear. The laces are also somewhat adjustable, resulting in a snug and comfortable fit for any size of primary footwear. In one implementation, the detachable fastening and threading of laces through the apertures allows the omission of a separate sewing operation from the assembly process and further allows easy replacement of damaged laces.

FIG. 2 depicts a top view of an example implementation of the overshoe 100. In FIG. 2, the toe anchor piece 106 is shaped to come up and over the toe of the primary footwear. The toe anchor piece 106 is split at the front and attaches to the perimeter of the sole 102 on either side of the toe (or the long axis 101 of the sole 102). The width of the toe anchor piece 106 contributes to the lateral stability of the overshoe 100.

The laces used with the sandal are inserted into the apertures (FIGS. 1 and 2, elements 115, 116, 120, and 122) in the heel, toe, and side anchor pieces. The arrangement of the anchor pieces and laces provides for a system that firmly holds the foot against movement in any direction, and yet is extremely simple to attach and detach. The laces are made of flexible material such as webbing or rubber-like compounds. The laces may be any shape in cross-section, and may be made of fabric laces, leather, cording, or shoe lace type laces. In one implementation, the laces include an attachment device at the ends, which attachment device is attached to the laces prior to the laces being inserted into the sandals. The attachment device may be hook and loop closures, buckles, toggles, latches, or any other type of releasable attachment device. Alternatively, the laces may be tied off to secure them.

In one implementation, wherein the laces to be used with the sandal are of a flat cross-section, such as webbing material, the apertures are elongated or slot-shaped (See FIGS. 1 and 2, apertures 115, 116, 120 and 122), and the angles of the apertures are selected to permit the laces to lie as flat as possible across the primary footwear of the user. In the implementation shown in FIG. 2, the aperture 115 of the toe anchor piece is approximately transverse to the long axis 101 of the sole 102, although other aperture shapes and orientations may be employed.

In this implementation also, the side anchor pieces 110 are approximately triangular, and contain two elongated or slot-shaped apertures each, 120 and 122. One aperture 120 in each side anchor piece 110 receives the back lace, thus connecting the heel anchor pieces 108 of the overshoe 100 to the side anchor pieces 110 of the overshoe 100. This aperture 120 is extends upwardly from the sole. The other aperture 122 of each side anchor piece 110 receives the front lace, thus connecting the side anchor pieces 110 of the overshoe 100 to the toe anchor pieces 106 of the overshoe 100, and is at approximately 45 degrees. Also in the illustrated implementation, the apertures 116 of the heel anchor pieces 108 extend upwardly from the sole 102.

Furthermore, as shown in FIG. 1, the side anchor pieces 110 extend along the perimeter of the midfoot of the sole 102 toward or to the ball of the sole 102 (i.e., where the ball of the wearer's foot would be located above the sole 102). FIG. 1 shows the side anchor piece 110 as tapering down to the surface of the sole 102, although a non-tapered or partially tapered side anchor piece may be employed. The extension of the side anchor pieces 110 forward toward the ball of the sole 102 provides lateral support and stability, limiting the sideways slipping of the primary footwear within the overshoe 100.

FIG. 3 depicts a back view of an example implementation of the overshoe 100. Two heel anchor pieces 108 are shown rising from the sole 102. Each heel anchor piece 108 includes an aperture 116 through which a rear lace is threaded. By coupling the heel anchor pieces 108 with the side anchor portions 110 (see e.g., FIG. 1) and in combination with the toe anchor piece 106 and a front lace, the heel of the wearer's primary footwear may be secured within the overshoe 100.

Figure 4:
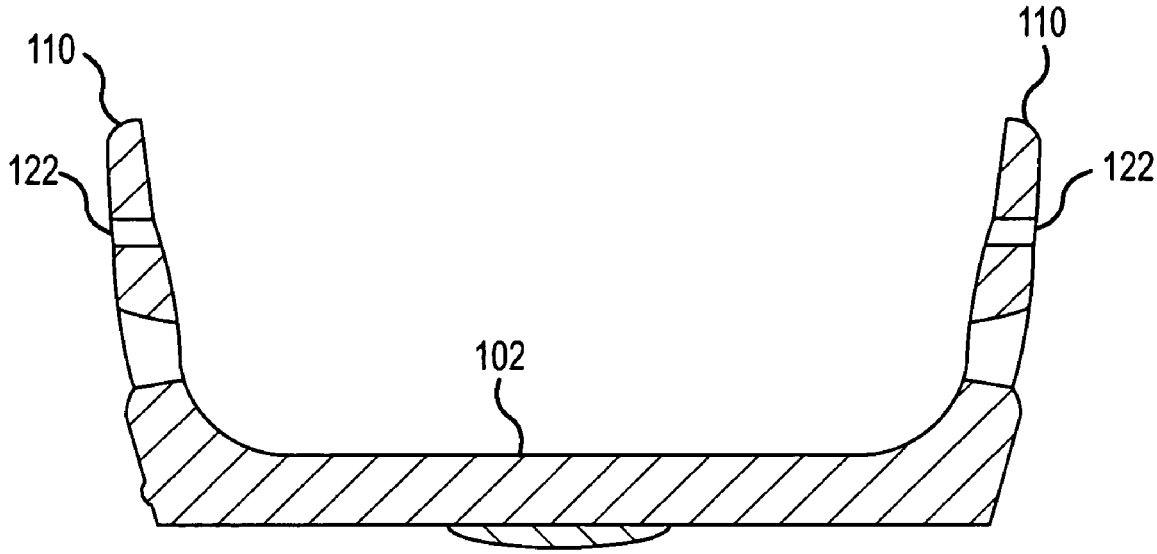
FIG. 4 depicts a cross-sectional view of the side anchor pieces of an example implementation of the overshoe.

FIG. 4 depicts cross-sectional view A-A of the side anchor pieces 110 of an example implementation of the overshoe 100. The apertures 122 and 111 are shown in the cross-sectional view, extending through each of the side anchor pieces 110, which rise from the sole 102. The apertures 122 are employed to receive a front lace of the overshoe 100. Although not shown, a different cross-sectional view at a location rearward of the view of FIG. 4 would illustrate a pair of apertures 120, which is employed to receive a rear lace of the overshoe 100.

FIG. 5 depicts a top view of an example implementation of the overshoe 100 with an example implementation of a lace system. A front lace 502 threads through the apertures 122 in the side anchor pieces 110 and the aperture 115 in the toe anchor piece 106 to couple the side anchor pieces 110 to the toe anchor piece 106. In FIG. 5, the front lace 502 fastens over the top of the wearer's primary footwear at the midfoot, although other locations of the fastening may be employed (e.g., at or near the toe anchor piece 106).

In addition, a rear lace 504 threads through the apertures 120 of the side anchor pieces 110 and the apertures 116 of the heel anchor pieces 108 to couple the side anchor pieces 110 to the heel anchor pieces 108. In one implementation, the rear lace 504 inserts through the aperture 116 of each flexible heel anchor piece 108 such that the rear lace 504 inserts through from the interior of the sole 102 perimeter toward the exterior of the sole 102 perimeter as it extends rearward. When pulled tight, the rear lace pulls in the heel anchor pieces 108 toward the interior of the sole 102 to secure the wearer's primary footwear into the overshoe 100. When loosened, the rear lace 504 allows the heel anchor pieces 108 to "open up" to release or receive the heel of the wearer's primary footwear FIG. 6 depicts a side view of an example implementation of the overshoe 100 with an example implementation of a lace system. The front lace 502 is shown threaded through the apertures of the side anchor pieces 110 and the toe anchor piece 106 for fastening over the top 500 of the wearer's primary footwear. By tightening the front lace 502, the toe anchor piece 502 is pulled down and back relative to the sole 102 to better secure the toe of the wearer's primary footwear. The rear lace 504 is show threaded through the apertures of the side anchor pieces 110 and the heel anchor pieces 108.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. An overshoe comprising:

a sole with a perimeter in the size and shape of a primary footwear sole, with a forefoot region, a midfoot region, and a hindfoot region;

a shaped flexible toe anchor piece located in the forefoot region of the sole and extending away from the sole, the shaped flexible toe anchor piece being split with a standing portion on each side of a long axis of the sole, each standing portion being integrally molded to the perimeter of at least one layer of the sole at the forefoot region and extending away from the sole toward the midfoot region and merging together along the long axis, wherein the shaped flexible toe anchor piece includes an aperture where the standing portions merge together;

two or more flexible side anchor pieces located in the midfoot region of the sole and extending away from the sole, the two or more flexible side anchor pieces being integrally molded to the perimeter of at least one layer of the sole on either side of the midfoot region, wherein each of the two or more flexible side anchor pieces includes an aperture; and two or more flexible heel anchor pieces located in the hindfoot region of the sole and extending away from the sole, the two or more flexible heel anchor pieces being integrally molded to the perimeter of at least one layer of the sole on either side of the hindfoot region.

2. The overshoe of claim 1 wherein each of the two or more flexible heel anchor pieces includes an aperture, and further comprising:

a rear lace releasably attaching through the apertures of the two or more flexible side anchor pieces and the two or more flexible heel anchor pieces.

3. The overshoe of claim 2 wherein the rear lace inserts through the aperture of each flexible heel anchor piece such that the rear lace inserts through from the interior of the sole perimeter toward the exterior of the sole perimeter as it extends rearward.

4. The overshoe of claim 1 further comprising:

a front lace releasably attaching through the apertures of the two or more flexible side anchor pieces and the shaped flexible toe anchor piece.

5. The overshoe of claim 4 wherein the flexible side anchor pieces each include two elongated apertures, one extending upwardly from the sole and one oriented at approximately 45 degrees with respect to the sole.

6. The overshoe of claim 5 wherein the front lace is configured to extend through the aperture in the shaped flexible toe anchor piece and through the elongated apertures in the flexible side anchor pieces oriented at approximately 45 degrees with respect to the sole.

7. The overshoe of claim 1 wherein each of the two or more flexible heel anchor pieces includes an aperture, and further comprising:

a rear lace releasably attaching through the apertures of the two or more flexible side anchor pieces and the two or more flexible heel anchor pieces, wherein the rear lace is releasably attached to the anchor pieces without sewing the rear lace to itself; and a front lace releasably attaching through the apertures of the two or more flexible side anchor pieces and the shaped flexible toe anchor piece, wherein the front lace is releasably attached to the anchor pieces without sewing the front lace to itself.

8. The overshoe of claim 7 wherein one end of the front lace releasably attaches to the other end of the front lace over top of primary footwear at the midfoot region after insertion through the apertures of the side anchor pieces.

9. The overshoe of claim 7 wherein the two or more flexible heel anchor pieces, the two or more flexible side pieces, the toe anchor piece, the rear lace, and the front lace secure the primary footwear of a wearer within the overshoe without additional laces.

10. The overshoe of claim 1 further comprising a second sole portion adhered to the sole, wherein said second sole portion comprises a ground engaging surface.

11. The overshoe of claim 10 wherein said ground engaging surface is selected from the group consisting of screws, cleats, spikes, studs, a grit coating, and a specially formulated rubber compound.

12. The overshoe of claim 1 wherein the two or more flexible side anchor pieces are biased outwardly from the interior of the sole.

13. The overshoe of claim 1 wherein the two or more flexible heel anchor pieces are biased outwardly from the interior of the sole.

14. An overshoe comprising:

a sole with a perimeter in the size and shape of a primary footwear sole, with a forefoot region, a midfoot region, and a hindfoot region;

a toe anchor piece located in the forefoot region of the sole and extending away from the sole, the toe anchor piece being split with a standing portion on each side of a long axis of the sole, each standing portion being attached to the perimeter of at least one layer of the sole at the forefoot region and extending: away from the sole toward the midfoot region and merging together along the long axis, wherein the toe anchor piece includes an aperture where the standing portions merge together;

two or more flexible side anchor pieces located in the midfoot region of the sole and extending away from the sole;

two or more flexible heel anchor pieces located in the hindfoot region of the sole and extending away from the sole; and a lacing system including a rear lace releasably attaching through apertures in each of the two or more flexible side anchor pieces and the two or more flexible heel anchor pieces, wherein the rear lace is releasably attached to the anchor pieces without sewing the rear lace to itself; and a front lace releasably attaching through apertures in each of the two or more flexible side anchor pieces and the aperture in the toe anchor piece, wherein the front lace is releasably attached to the anchor pieces without sewing the front lace to itself.

15. The overshoe of claim 14 wherein one end of the front lace releasably attaches to the other end of the front lace over top of primary footwear at the midfoot region after insertion through the apertures of the side anchor pieces.

16. The overshoe of claim 14 wherein the two or more flexible heel anchor pieces, the two or more flexible side pieces, the toe anchor piece, the rear lace, and the front lace secure the primary footwear of a wearer within the overshoe without additional laces.

17. The overshoe of claim 14 wherein each of the flexible heel anchor pieces is integrally molded into at least one layer of the sole at either side of the hindfoot region.

18. The overshoe of claim 14 wherein each of the flexible side anchor pieces is integrally molded into at least one layer of the sole at either side of the midfoot region.

19. The overshoe of claim 14 wherein the toe anchor piece is integrally molded into at least one layer of the sole at the forefoot region.

20. The overshoe of claim 14 wherein the sole includes a ground engaging surface selected from the group consisting of screws, cleats, spikes, studs, a grit coating, and a specially formulated rubber compound.

21. The overshoe of claim 14 wherein the flexible side anchor pieces each include two elongated apertures, one extending upwardly from the sole and one oriented at approximately 45 degrees with respect to the sole.

22. The overshoe of claim 21 wherein the front lace is configured to extend through the aperture in the toe anchor piece and through the elongated apertures in the flexible side anchor pieces oriented at approximately 45 degrees with respect to the sole.

23. An overshoe comprising:

a sole with a perimeter in the size and shape of a primary footwear sole, with a forefoot region, a midfoot region, and a hindfoot region;

a flexible toe anchor piece located in the forefoot region of the sole and extending away from the sole the flexible toe anchor piece being split with a standing portion on each side of a long axis of the sole, each standing portion being attached to the perimeter of at least one layer of the sole at the forefoot region and extending away from the sole toward the midfoot region and merging together along the long axis, wherein the flexible toe anchor piece includes an aperture where the standing portions merge together; and two or more flexible heel anchor pieces located in the hindfoot region of the sole on either side of the long axis, the two or more flexible heel anchor pieces being molded to extend away from the sole and to angle away from the interior of the sole independently at a non-perpendicular angle to the sole.

24. The overshoe of claim 23 further comprising:

two or more flexible side anchor pieces located in the midfoot region of the sole and extending away from the sole;

a rear lace releasably attaching through apertures in each of the two or more flexible side anchor pieces and the two or more flexible heel anchor pieces, wherein the rear lace is releasably attached to the anchor pieces and the two or more flexible anchor pieces angle away from the interior of the sole independently at a non-perpendicular angle to the sole when the rear lace is loose and angle toward the interior of the sole independently at a non-perpendicular when the rear lace is drawn tight.

* * * * *